US010597877B2

(12) United States Patent
Wilbs

(10) Patent No.: US 10,597,877 B2
(45) Date of Patent: Mar. 24, 2020

(54) FITTING FOR LAYING DECKING BOARDS

(71) Applicant: alfer aluminium Gesellschaft mbH, Wutoschingen (DE)

(72) Inventor: Thomas Wilbs, Uhlingen-Birkendorf (DE)

(73) Assignee: ALFER ALUMINIUM GESELLSCHAFT MBH, Wutoschingen (DE)

( * ) Notice: Subject to any disclaimer, the term of this patent is extended or adjusted under 35 U.S.C. 154(b) by 0 days.

(21) Appl. No.: 15/844,580

(22) Filed: Dec. 17, 2017

(65) Prior Publication Data

US 2018/0171643 A1 Jun. 21, 2018

(30) Foreign Application Priority Data

Dec. 20, 2016 (DE) ..... 10 2016 124 988

(51) Int. Cl.
*E04F 15/02* (2006.01)
*E04F 21/00* (2006.01)

(52) U.S. Cl.
CPC .. *E04F 15/02044* (2013.01); *E04F 15/02183* (2013.01); *E04F 21/0092* (2013.01); *E04F 2015/02072* (2013.01); *E04F 2201/0511* (2013.01); *E04F 2203/04* (2013.01)

(58) Field of Classification Search
CPC ..... E04F 15/02044; E04F 15/02183; E04F 2201/0511; E04F 2015/02072; E04F 21/22; E04F 13/26; E04F 2015/0205; E04F 2015/02066
USPC ..... 52/489.1, 586.1, 391, 747.11, 749.11, 52/480, 506.06, 509, 715, 127.2
See application file for complete search history.

(56) References Cited

U.S. PATENT DOCUMENTS 2,882,560 A * 4/1959 Plendl ..... E04F 15/022 52/391
3,405,493 A * 10/1968 Omholt ..... E04F 13/0826 52/402
3,553,919 A * 1/1971 Omholt ..... E04F 15/04 52/480
3,713,264 A * 1/1973 Morgan, Jr. ..... E04F 15/04 52/480
4,223,505 A * 9/1980 Krebel ..... E04F 13/0823 52/489.2
4,603,528 A * 8/1986 Sigerist ..... E04F 13/0803 52/464

(Continued)

FOREIGN PATENT DOCUMENTS

DE 102008018072 B3 3/2009
DE 102008056435 A1 5/2010

(Continued)

*Primary Examiner* — Brent W Herring
(74) *Attorney, Agent, or Firm* — Notaro, Michalos & Zaccaria P.C.

(57) ABSTRACT

The invention relates to a fitting for connecting and laying panels, boards or planks on a supporting body, having a main body and a spacer, wherein the main body has at least two fastening devices for connecting the fitting and board and for connecting the fitting and supporting surface, wherein the spacer and main body are arranged predominantly at right angles to one another in the operating state, characterized in that the main body and spacer are connectable together in a releasable manner by a third fastening device.

9 Claims, 7 Drawing Sheets

(56) References Cited

U.S. PATENT DOCUMENTS 4,620,403 A * 11/1986 Field ..... E01D 19/125 52/480
4,844,651 A * 7/1989 Partridge ..... E04B 5/12 403/386
4,858,399 A * 8/1989 Salato, Jr. ..... E04B 1/003 52/97
5,027,573 A * 7/1991 Commins ..... E04B 1/2608 52/480
5,727,354 A * 3/1998 Clement ..... E04F 13/0803 52/387
6,619,000 B1 * 9/2003 Chiu-Ying ..... E04F 15/04 269/291
6,625,951 B1 9/2003 McCarthy
6,810,633 B2 * 11/2004 Harris, Sr. ..... E04B 5/12 52/489.2
6,857,242 B2 * 2/2005 He ..... E04F 13/10 52/480
8,006,458 B1 * 8/2011 Olofsson ..... E04F 15/02 52/489.1
8,146,303 B2 * 4/2012 Gibson ..... E04B 5/12 52/177
8,429,878 B1 * 4/2013 Hoffman ..... E04F 13/0889 52/747.11
8,429,879 B1 * 4/2013 Hoffman ..... E04F 21/0092 52/747.11
8,561,370 B1 * 10/2013 Hoffman ..... E04F 13/0889 52/747.11
8,572,927 B1 * 11/2013 Hoffman ..... E04F 13/0889 52/747.11
8,607,530 B2 * 12/2013 Hoffman ..... E04F 21/00 52/747.11
8,689,521 B1 * 4/2014 Hoffman ..... E04F 13/0889 52/747.11
8,689,522 B2 * 4/2014 Hoffman ..... E04F 21/00 52/747.11
8,910,442 B2 * 12/2014 Lachevrotiere ... E04F 15/02044 52/489.1
9,097,026 B2 * 8/2015 Hoffman ..... E04F 21/22
9,458,635 B1 * 10/2016 Anic ..... E04F 15/02183
9,464,448 B2 * 10/2016 Hoffman ..... E04F 21/22
10,119,273 B2 * 11/2018 Andres ..... E04F 15/02044
2004/0206028 A1 * 10/2004 Terrels ..... E04H 17/1443 52/287.1
2006/0156664 A1 * 7/2006 Chae ..... E04F 13/0814 52/480
2008/0190069 A1 * 8/2008 Van Fleet ..... E04F 15/02183 52/712
2008/0222993 A1 * 9/2008 Prichard ..... E04F 15/02005 52/702
2008/0271410 A1 * 11/2008 Matthee ..... E04F 15/02044 52/749.11
2011/0173916 A1 * 7/2011 Knapp ..... E04F 15/04 52/650.3
2013/0104497 A1 * 5/2013 Ross ..... E04F 21/185 52/749.11
2013/0118115 A1 * 5/2013 Hoffman ..... E04F 21/0092 52/747.11
2013/0247508 A1 * 9/2013 Hoffman ..... E04F 21/00 52/749.11
2014/0041335 A1 * 2/2014 Hoffman ..... E04F 21/00 52/747.11
2014/0260041 A1 * 9/2014 Peck ..... F16B 5/0685 52/489.1
2014/0260043 A1 * 9/2014 Cottier ..... E04F 13/0826 52/489.2
2014/0325935 A1 * 11/2014 Hoffman ..... E04F 21/22 52/747.11
2015/0128519 A1 * 5/2015 Weber ..... E04F 15/02038 52/489.1
2015/0337546 A1 * 11/2015 Hoffman ..... E04F 21/22 52/126.5
2017/0009464 A1 * 1/2017 Hoffman ..... E04F 21/22

FOREIGN PATENT DOCUMENTS

DE 20 2009 002 967 U1 7/2010
DE 102009043993 A1 1/2011
DE 102014115257 A1 4/2016
DE 102016000829 A1 7/2017
DE 202017106552 U1 12/2017
EP 1700966 A1 9/2006
EP 2 527 550 A2 11/2012
EP 2527550 A2 11/2012
WO 2014/160076 A1 10/2014

* cited by examiner

FITTING FOR LAYING DECKING BOARDS

FIELD AND BACKGROUND OF THE INVENTION

The invention relates to a fitting for connecting panels, boards or planks, collectively referred to as boards in the following text, having a supporting body, in particular in the field of decking or other outdoor areas.

Boards are generally screwed to a supporting structure in a manner arranged parallel to one another via a fitting attached to the board. This supporting structure can comprise spaced-apart beams or be a uniform surface, for example a surface consisting of OSB panels, concrete or other materials, to which the boards are attached. In this case, the boards subsequently to be laid are oriented with respect to the already laid boards in terms of parallelism and spacing, wherein joints form between the boards. Depending on the material and prevailing environmental conditions, the dimensions of the boards change, i.e. the size of the joint changes over time. In order to obtain a uniform joint pattern, it is known to provide fittings with spacers which project into the joint between adjacent boards, come into contact with the latter and remain in the joint.

Such a fitting is known from EP 2 527 550 A2. Said document discloses a fitting for connecting planks to a substructure, wherein each fitting projects under two planks and is connected to the two planks with at least one screw in each case, wherein the fitting rests on the substructure and is connected thereto by a screw, wherein the fitting comprises a material tongue with a particular thickness which is firmly connected to the fitting.

DE 20 2009 002 967 U1 discloses a fitting for planks, said fitting having a passage opening for a fastening bolt, wherein the fitting comprises an elastic guide insert as spacer. The guide insert is a claw connected firmly to the fitting, said claw engaging in lateral recesses in the planks and projecting laterally beyond the latter.

A drawback of this prior art is that these spacers bear firmly against adjacent boards and thus at least locally prevent the dimensions of the completely fitted boards from changing, this then possibly resulting in deformation of the supporting structure and/or deformation of the floor surface, this resulting in fundamentally dangerous tripping hazards. A further drawback is that these spacers define a particular joint width, although it may be appropriate, depending on the board material to be laid, to configure the joint widths to be selectable.

SUMMARY OF THE INVENTION

Therefore, the invention is based on the object of specifying a fitting that is usable in a more versatile manner and avoids the drawbacks of the prior art.

This object is achieved, in the case of a fitting having a main body and a spacer, wherein the main body has at least two fastening devices, wherein the spacer and main body are arranged predominantly at right angles to one another in the operating state, in that the main body and spacer are connectable together in a releasable manner by means of a third fastening device.

The fitting according to the invention has at least two fastening devices which serve for the one part for fastening to a board and for the other part for fastening the fitting to a substructure. These two fastening devices may be of identical or different types, and may also be fastening means themselves, but fastening devices of a passive type, in particular through-openings, are preferred. The first fastening device is arranged on the fitting such that, in use, it is arranged in the region covered by a board, and the second is arranged such that it is not covered. The main body can in this case have any desired circumferential shape, as long as it has a portion which is arranged under a board in use and has two portions which are not arranged under the board. In particular, the main body can be triangular, rectangular, square, oval, round, polygonal or the like, rectangular shapes being preferred. The spacer is arranged predominantly at right angles to the main body in the operating state of the fitting, with the result that it allows the board to rest optimally on its surface. The expression "predominantly at right angles" is understood here to include angles in the range from 90°±2.5°. The invention thus proposes, with a great advantage, designing the main body and spacer to be connectable together in a releasable manner by means of a third connecting device. This has the great advantage that the spacer is removable from the joint after the board has been laid, such that it does not hinder the dimensional change thereof and at the same time realizes a cleanly worked joint. At the same time, this has the advantage that fundamentally differently shaped, in particular thick, spacers can be provided and can be connectable to a main body, such that one type of main body is sufficient to realize different joint widths.

The development of the invention according to which the third fastening device is in the form of a plug-in slot is particularly advantageous. A plug-in slot, that is to say a male/female configuration of the third connecting device, simplifies and accelerates the connecting of the two components of the fitting, wherein especially the removal of the spacer from a joint is easy, it being sufficient just to pull on the spacer. More complicated manners of fastening are advantageously avoided. According to the invention, each of the two components can in this case be configured in either a male or a female manner, wherein the other is then formed in each case in the opposite manner. In particular, the fitting can have a peg over which a bore of the spacer engages, or the fitting can have a receiving opening, such as a blind hole, in which a correspondingly shaped part of the spacer engages. The latter is preferred, since in this way the main body can be configured as an extruded or injection-moulded part which has only smooth surfaces without projecting parts, thereby additionally also reducing the risk of injury to a user.

In a development of the invention, the third fastening device is in the form of a through-opening in the main body and in the form of a correspondingly shaped plug-in end in the spacer. Thus, the entire thickness of the main body is available for guiding the spacer, which is firmly anchored in a corresponding manner and is not tilted, or tilted only a little, out of the perpendicular position by the force exerted thereon by the pressure of a board.

If the main body has two longer sides and two shorter sides and has two ends, wherein the second and third fastening devices are each arranged in the region of one end, and wherein the first fastening device is arranged between the second and third fastening devices, this, with great advantage, allows the main body to be of narrow construction and also to project with its two ends under the board in use, in order both to keep the second and the third fastening device accessible and to allow connection to an already laid board, in particular by pushing under the latter. It is therefore in the form of a rectangle.

Furthermore, the invention proposes that the through-opening have an H-shaped cross-sectional area, wherein a connecting portion of the H shape extends parallel to the shorter side and orthogonally to the longer side of the main body. Generally, the through-opening can be formed with any cross-sectional shape, in particular a rectangular or a square or a round one. It can thus be selected irrespective of the cross-sectional shape of the spacer which is provided in the axial region thereof that serves for bearing on a board. A rectangular shape, or an H shape, is particularly preferred, however, since this allows a secure hold and the spacer can be formed with a cross-sectional area that is uniform and constant along its axial course, resulting in a spacer that is held in a structurally particularly simple manner. The spacer can thus be anchored particularly well with the two ends of the through-opening, which are thickened compared with the connecting portion.

In one configuration of the invention, the connecting portion has at least one, preferably several, in particular three protrusions projecting into it. The protrusions can in turn have any desired cross-sectional area in this case, as long as they constrict the free diameter of the connecting portion, with the result that they represent an obstacle for the plugging of the spacer into the through-opening in the third fastening device that is easy to overcome by light force exertion. As a result, additional stability of the spacer in the plug-in slot of the main body of the fitting is ensured by a force fit and slipping of the spacer through the through-opening is limited even in the event of a lack of constriction of the opening or a lack of widening of the spacer. From a production point of view, simple punching of the through-opening and of the spacer is thus allowed. A relatively large number is in this case considered to be advantageous for the number of protrusions in the connecting region of the H-shaped through-opening, since a relatively small number of protrusions can result in twisting or tilting of the spacer in the through-opening. An excessively large number of protrusions, by contrast, requires a relatively large force to be exerted for the plugging in and the releasing of the spacer from the plug-in slot. Although this results in particularly high stability of the connection of the main body and spacer, it counteracts the basic idea of the plug-in system being easy to release. Therefore, three protrusions in particular are considered to be advantageous according to the invention.

In one configuration of the invention, the spacer is formed in an H-shaped or rectangular manner in cross section. It thus has the same dimensions as, or smaller dimensions than, the through-opening, thereby allowing different spacer shapes and thicknesses. If it is formed in a rectangular manner, it engages in particular with the protrusions and bends the latter out of the plane of the main body, wherein a minimum thickness of the spacer is defined such that it is still just in contact with the free ends of protrusions that are located opposite one another in the through-opening. If it is formed in an H-shaped manner with pronounced or not very pronounced crossbars, the latter fit into the through-opening in a form-fitting manner to a greater or lesser degree even in the thickened end regions thereof.

If the spacer has different thicknesses, in particular 1.2 mm; 2 mm and 4 mm, ideal joint widths can be realized for the boards, depending on the material or thickness thereof, in order to allow the boards to expand.

Furthermore, the invention advantageously proposes that the main body have at least one groove extending orthogonally to the longer side. Ideally, the main body, which is wider than the board width, has two grooves, wherein the grooves are arranged on the fitting such that they are a board's width away from one another. The technical benefit of the grooves resides in marking that region which is located under the board in use. This ensures that the second and third connecting devices are freely accessible and not blocked. This also ensures that the spacer bears against the board, in particular flat against the board. If a board has to be attached in the vicinity of an obstacle such as a pillar or a wall, it is possible for those parts of the fitting that project under the board and serve to fasten it to the supporting surface to prevent clean insertion of the board at said point. The grooves allow clean removal of the disruptive part here, too, with the orientation being maintained by way of the grooves.

The invention proposes in particular that the main body have two grooves, which extend between the first and the third, and the first and the second fastening device. The result implemented thereby is that the first fastening device is arranged in a region of the main body which bears against the underside of the board. The other two fastening devices are located in a corresponding manner on the regions of the main body that protrude under the board, with the result that the spacer in the third fastening device is located in a joint after the board has been joined to the already laid boards, and it is possible to simply fasten the fitting to the supporting body by way of the second fastening device.

For optimal application of the invention, a method for fastening boards to a supporting body at right angles thereto using a fitting is proposed, having the steps of:

a) releasably fastening a spacer to a main body by means of a third fastening device,
b) fastening the fitting to a board by means of the first fastening device,
c) fastening the assembled fitting and board to a supporting body by means of the second fastening device,
d) repeating steps a) and b) on one or more further boards,
e) inserting the fittings fastened to the further board under the board attached in step c) until the spacer of the further board bears against the already fastened board,
f) removing all the spacers.

First of all, the spacer is fastened to the main body by the third fastening device. If the fitting consisting of the main body and spacer is arranged under the board for fastening, the fitting can be shifted such that the spacer bears against the board. If desired, the two steps can be interchanged such that the main body is first of all fastened to the board by orientation with the aid of the grooves in the board and subsequently the spacer is inserted. As a result of the arrangement of the grooves in the main body, the third fastening device is visible on the board side such that the spacer can be plugged in without problems and bears against the board. It is likewise possible for the two abovementioned steps to optionally be carried out first of all for all the boards to be laid before they are laid and attached to the supporting body. This more extensive preparation does not have any effect on the overall sequence of the method and can thus be carried out as per the preference of a user. Subsequently, provision is made for the assembled board and fitting to be oriented with the boards already attached to the support body and pushed against said boards such that the boards are at the same vertical height and the fittings of the boards to be attached to the supporting body are pushed under the already attached boards until the spacer bears against the already attached board and thus determines the joint width. Ideally, the end with the third fastening device is thus already located partially under the board already fastened to the supporting body. After the board has been oriented, the second fastening device is used to fasten the fitting to the supporting body. Provision is also made for the next board to be laid to be prepared for laying by the attachment of a fitting, unless this has already taken place beforehand. This board, too, is joined in an oriented manner to the previously laid board such that the spacer again determines the joint between these boards. Provision is made for these steps to be repeated as many times as necessary until all the boards have been laid and fastened to the supporting body. Once this has occurred, according to the invention, all the spacers are removed from the joints.

The invention proposes that the spacers of a fitting that has just been laid be removed and/or that steps a) and b) be interchanged. This has the advantage that it is easily possible to move on the partially laid board floor without spacers protruding depending on length.

BRIEF DESCRIPTION OF THE DRAWINGS

The invention is described by way of example in the preferred embodiment with reference to the following figures.

DESCRIPTION OF THE PREFERRED EMBODIMENT

Figure 1A:
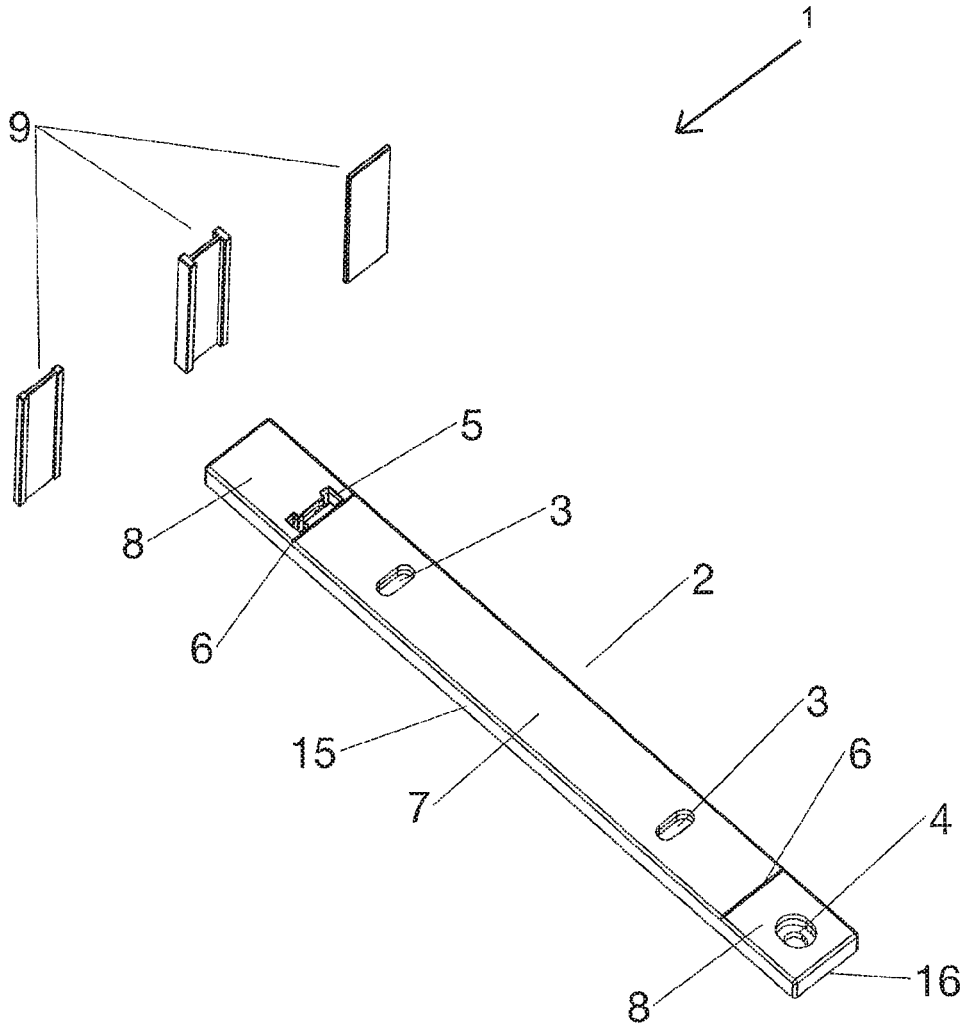
FIG. 1*a* shows a schematic, perspective view of a main body and three spacers.
Figure 1B:
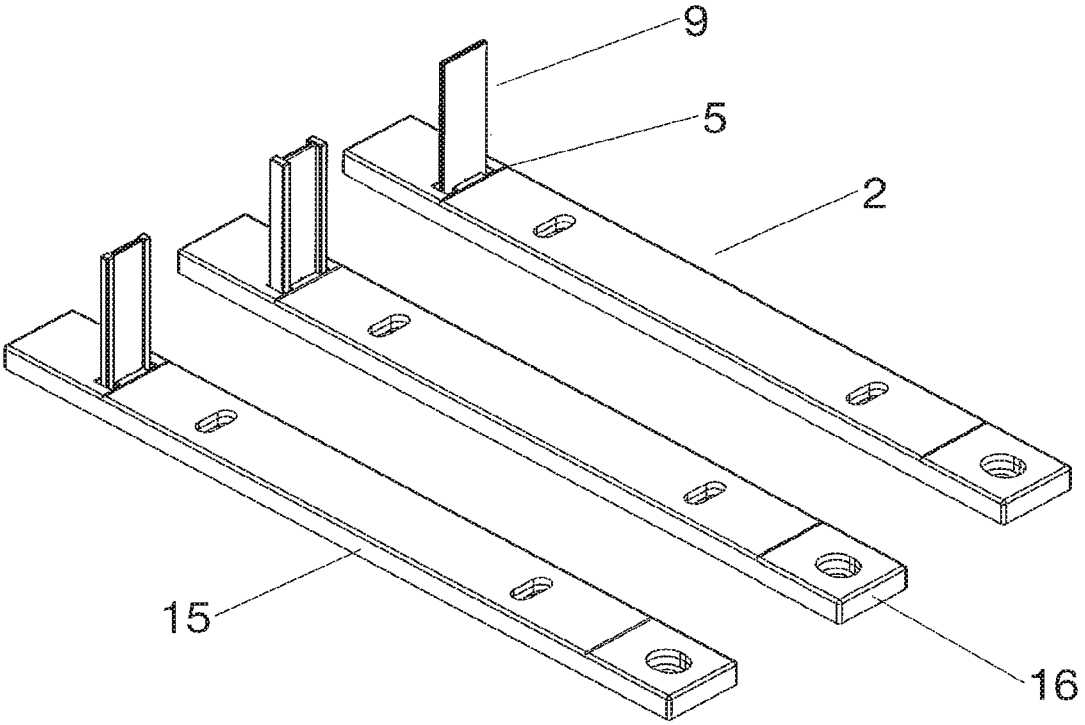
FIG. 1*b* shows a schematic, perspective view of three fittings with inserted spacers.

FIGS. 1*a* and 1*b* show an elongate, rectangular main body 2 according to the invention, having two longer sides 15 and two shorter sides 16, said main body 2 having three different fastening devices 3, 4, 5. The first fastening device 3 is provided twice as a through-opening in the form of an oblong hole in the central region 7 of the main body 2, in particular with the long side parallel to the shorter sides 16. These advantageously allow the fitting to shift when the dimensions of the board change, without a screw that passes through the oblong hole tearing out. Of course, round or polygonally configured through-openings are also in accordance with the invention, in particular when carriage bolts are intended to be used as fastening means. The second fastening device 4 is likewise in the form of a through-opening, but in this case with a stepped radius, as seen axially, in order to allow a fastening means 12 to be countersunk, resulting in a flat surface. This allows clean introduction of a board 13 to be laid at a board 13 already fastened to a supporting body 14 beforehand by a second fastening device 4. The third fastening device 5 is in the form of a through-opening with an H-shaped cross section. Each spacer 9 which is shown in three different embodiments in FIG. 1*a*, fits, as illustrated in FIG. 1*b*, into the third fastening device 5 configured in a uniform manner for each main body 2, since the thickness of that part of the spacer 9 that is to be arranged orthogonally to the longer side of the main body 2 corresponds to the thickness of the corresponding connecting portion 10 of the third fastening device 5. The cross section of the spacer 9 is formed in an H-shaped or rectangular manner according to the invention. FIGS. 1*a* and 1*b* show a further variant of the spacer 9 with a less pronounced H-shaped cross section. The main body 2 has two grooves 6 which separate the central region 7 of the main body 2 from the two end regions 8.

Figure 2:
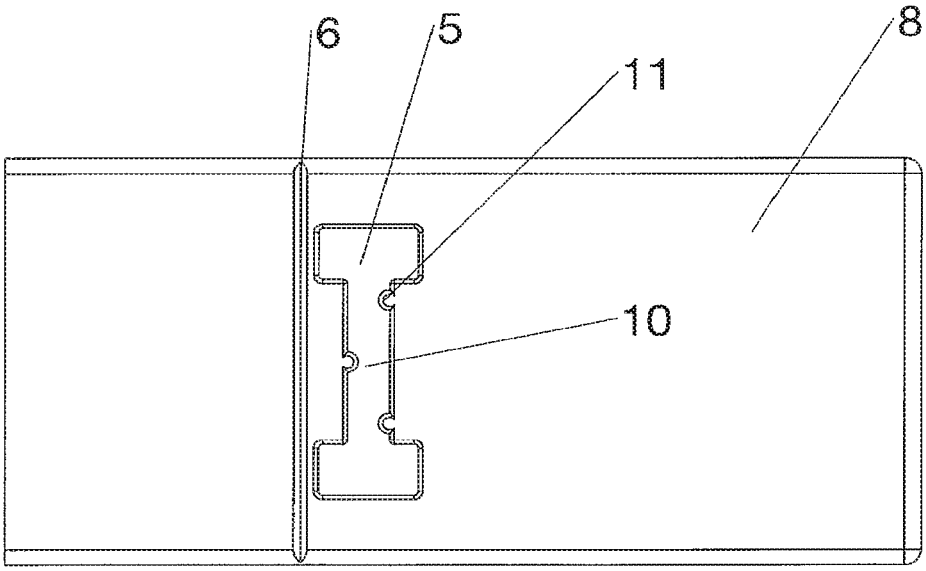
FIG. 2 shows a close-up view of a fastening device for spacers.

FIG. 2 shows a detail view of the main body 2 according to the invention with the third fastening device 5 and a groove 6. The groove 6 marks the boundary between the end region 8, in which the third fastening device 5 is located, and the rest of the main body. The third fastening device 5 is in the form of a through-opening and has a connecting portion 10 between the two thickened ends of the H-shaped through-opening. Three protrusions 11, which are in the form of semicircles here, can be seen. These can be deformed to such an extent by relatively light force exertion when a spacer is introduced that the latter is held in a force-fitting manner.

Figure 3A:
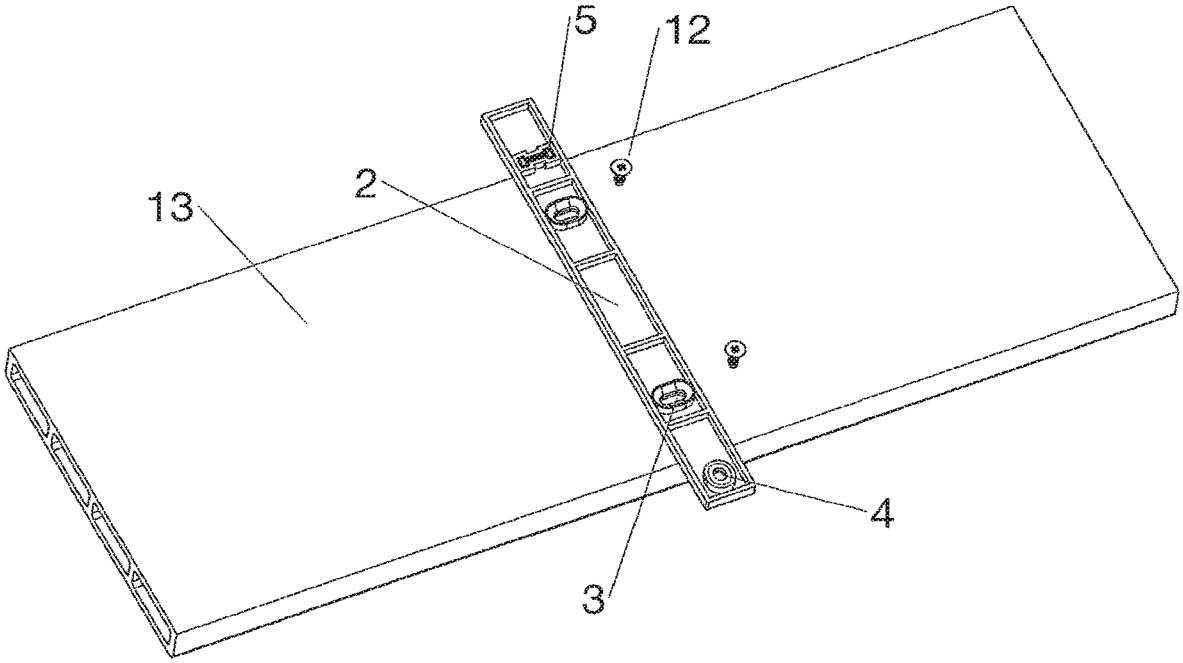
FIG. 3*a* shows the attachment of a fitting to a board underside.
Figure 3B:
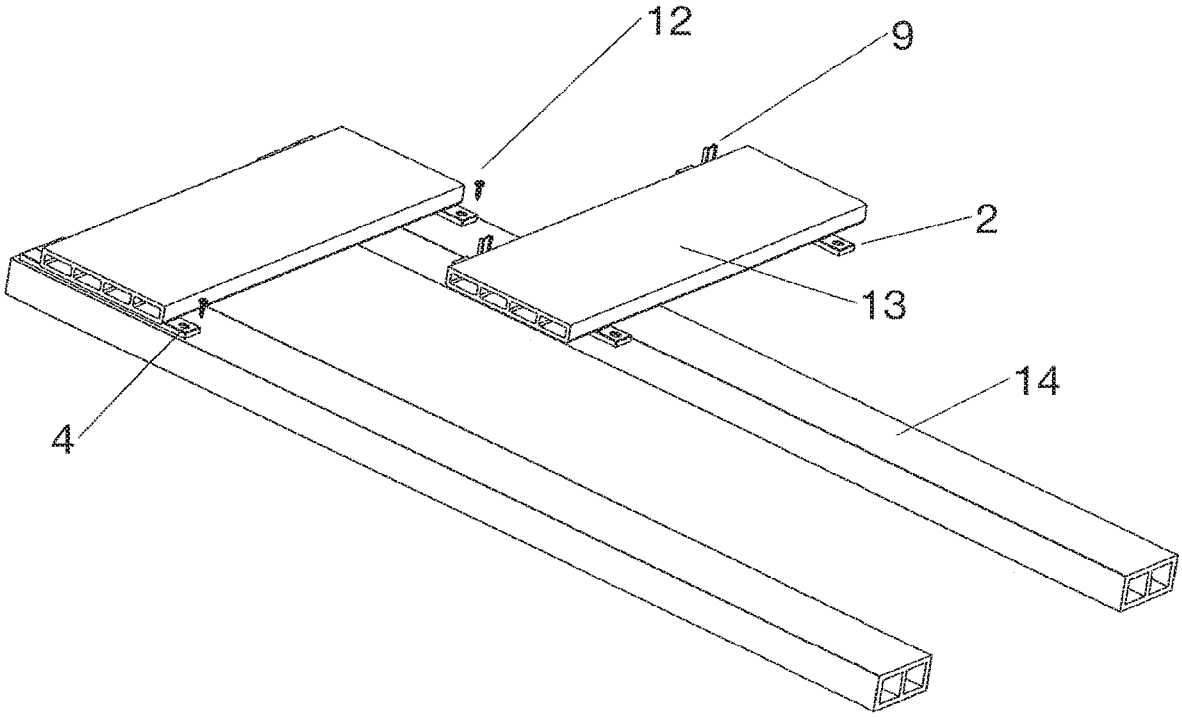
FIG. 3*b* shows the attachment of a board to a supporting surface.
Figure 3C:
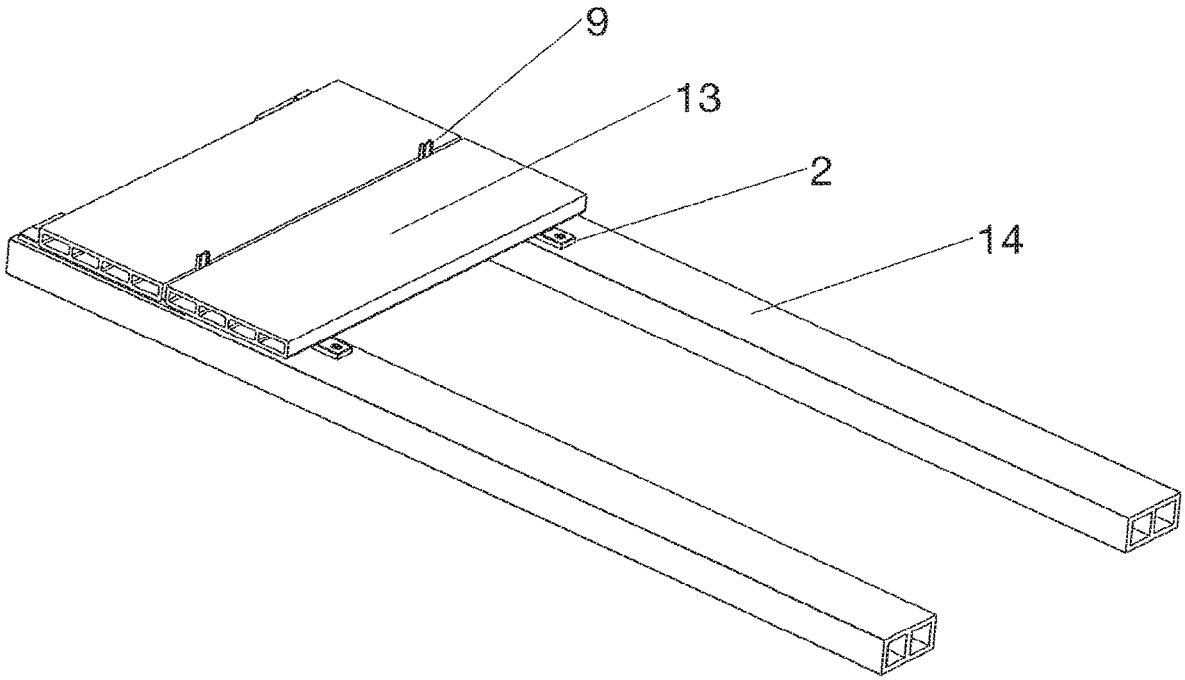
FIG. 3*c* shows the orienting of a board with respect to a board already fastened to the supporting surface with the aid of spacers.

FIGS. 3*a* to 3*d* explain the method according to the invention for laying and fastening boards 13 on a supporting body 14 by means of the fittings 1. FIG. 3*a* shows the fastening of the fitting 1 to the underside of a board 13, for which purpose the fitting 1 is held with its corresponding side on the board 13 and is fastened to the latter by means of fastening means 12 which are embodied here as screws, specifically by way of the first fastening device 3. It can be seen that the main body 2 has stiffening webs both along the longer and shorter sides 15, 16 and in the region in between, in this case three webs parallel to the two outer webs on the shorter side 16. The first and second fastening devices 3, 4 in the form of the through-openings that are the oblong hole and axially stepped round hole are in this case likewise provided with circumferential webs for reinforcement and for creating a uniform underside lining. It would also be in accordance with the invention to manufacture the main body from a solid material into which the through-openings are introduced. The manner of construction illustrated saves material and weight, however, with the same stability.

Figure 3D:
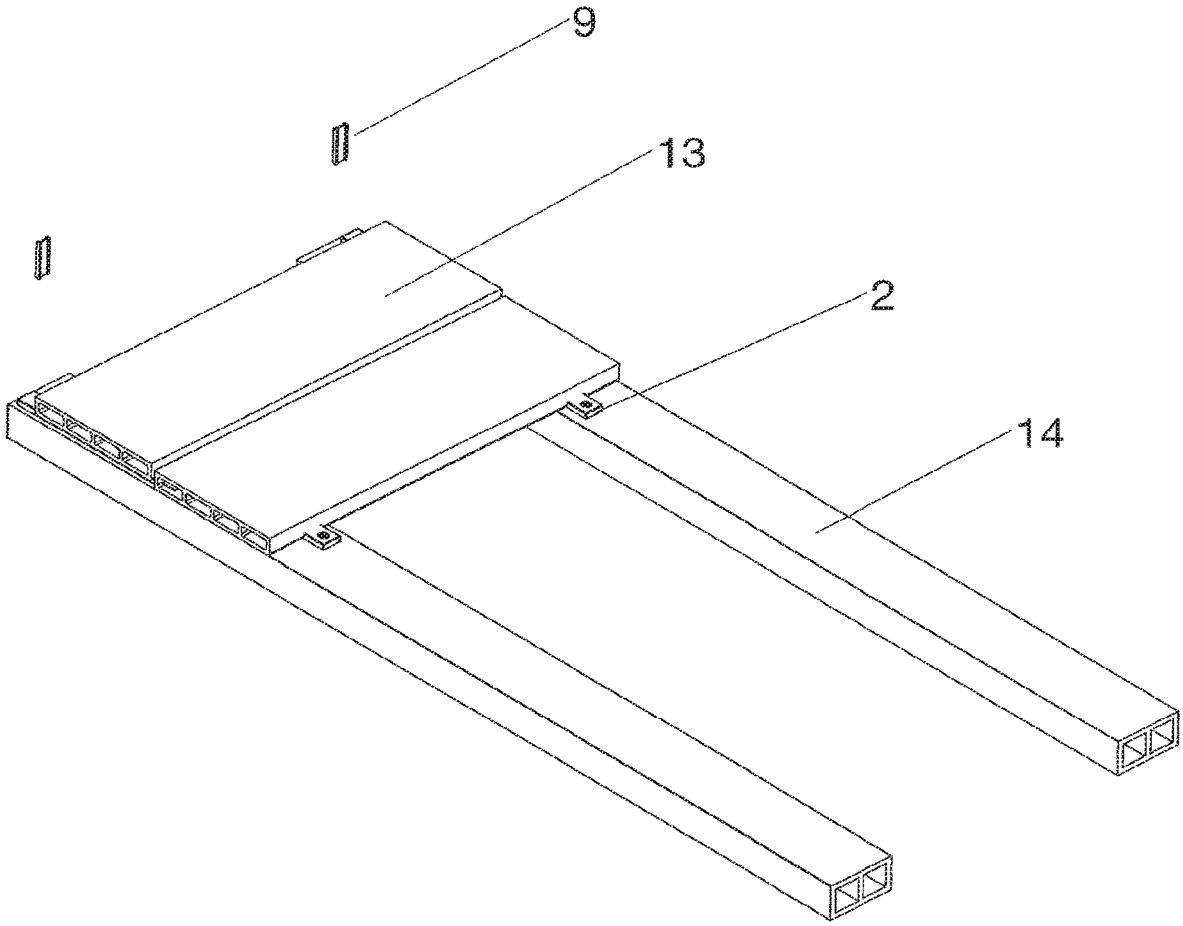
FIG. 3*d* shows the removal of spacers from a joint between two boards already fastened to the supporting surface.

In a similar manner to the second fastening device 4 in FIG. 1*a*, the through-openings in the first fastening device 3 have a stepped radius as seen axially, in order to countersink the fastening means 12 in the through-opening. The fitting 1 protrudes with its two ends 8 beyond the board width. As a result, both the second fastening device 4 and the third fastening device 5 are located next to the board 13. The board 13 is fastened to the supporting body 14 by means of fastening means 12, in this case screws, which pass through the second fastening device 4 of the fittings 1. In the process, the fitting 1 is only fastened to the supporting body 14 after the board 13 has been positioned thereon. Subsequently, the board 13 with fastened fittings 1 is placed on a supporting body 14 and pushed towards the already mounted boards 13 until the spacers 9 bear against the already laid board 13 and define the desired joint. Finally, FIG. 3*d* shows the removal of the spacers 9 from the third fastening device 5 of the main body 2 already attached to the supporting body 14. As already mentioned above, the order of the working steps is interchangeable.

LIST OF REFERENCE SIGNS

1 Fitting
2 Main body
3 First fastening device
4 Second fastening device
5 Third fastening device
6 Groove
7 Central region

8 End region
9 Spacer
10 Connecting portion
11 Protrusion
12 Fastening means
13 Board
14 Supporting body
15 Longer side
16 Shorter side

The invention claimed is:

1. Fitting (1) having a main body (2) and a spacer (9), wherein the main body (2) has at least two fastening devices (3, 4), wherein the spacer (9) and main body (2) are arranged predominantly at right angles to one another in the operating state, characterized in that the main body (2) and spacer (9) are connectable together in a releasable manner by means of a third fastening device (5) wherein the first fastening device (3) serves the fitting (1) such that the main body (2) is fastened to a board (13) by the first fastening device (3), wherein the first fastening device (3) is arranged such that, in use, it is in the region covered by a board (13), wherein the second fastening device (4) serves the fitting (1) such that the main body (2) is fastened to a supporting body (14), wherein the second fastening device (4) is arranged such that, in use, it is not covered by a board (13), wherein the third fastening device (5) is in the form of a through-opening in the main body (2) and in the form of a plug-in end in the spacer (9).

2. Fitting (1) according to claim 1, wherein the third fastening device (5) is in the form of a plug-in slot.

3. Fitting (1) according to claim 1, wherein the main body (2) has two longer sides (15) and two shorter sides (16) and has two ends (8), wherein the second and third fastening devices (4, 5) are each arranged in the region of one end (8), and wherein the first fastening device (3) is arranged between the second (4) and third (5) fastening devices.

4. Fitting (1) according to claim 1, wherein the third fastening device (5) is in the form of a through-opening in the main body (2) wherein the through-opening has an H-shaped cross-sectional area, wherein the main body (2) has two longer sides (15) and two shorter sides (16), wherein a connecting portion (10) of the H shape extends orthogonally to the longer sides (15) of the main body (2).

5. Fitting (1) according to claim 4, wherein the connecting portion (10) has at least one protrusion (11) projecting into it.

6. Fitting (1) according to claim 1, wherein the spacer (9) is formed in an H-shaped or rectangular manner in cross section.

7. Fitting (1) according to claim 1, wherein the spacer (9) has different thicknesses.

8. Fitting (1) according to claim 1, wherein the main body (2) has at least one groove (6) extending orthogonally to the longer side.

9. Fitting (1) according to claim 1, wherein the main body (2) has two grooves (6), which extend between the first (3) and the third (5), and the first (3) and the second (4) fastening device.

* * * * *